US011183353B2

(12) United States Patent
Fan

(10) Patent No.: US 11,183,353 B2
(45) Date of Patent: Nov. 23, 2021

(54) FUSES, VEHICLE CIRCUIT FOR ELECTRIC VEHICLE AND ELECTRIC VEHICLE

(71) Applicant: COOPER XI'AN FUSE CO., LTD., Xi-an (CN)

(72) Inventor: Gangpeng Fan, Xi'an (CN)

(73) Assignee: COOPER XI'AN FUSE CO., LTD.

( * ) Notice: Subject to any disclaimer, the term of this patent is extended or adjusted under 35 U.S.C. 154(b) by 0 days.

(21) Appl. No.: 16/670,170

(22) Filed: Oct. 31, 2019

(65) Prior Publication Data

US 2020/0168422 A1 May 28, 2020

(30) Foreign Application Priority Data

Nov. 28, 2018 (CN) ..... 201821973510.7

(51) Int. Cl.

| | |
|---|---|
| ***H01H 85/175*** | (2006.01) |
| ***H01H 85/055*** | (2006.01) |
| ***H01H 85/20*** | (2006.01) |
| ***H01H 85/143*** | (2006.01) |
| ***H01H 85/38*** | (2006.01) |
| ***H01H 85/47*** | (2006.01) |

(52) U.S. Cl.

CPC ..... *H01H 85/175* (2013.01); *H01H 85/055* (2013.01); *H01H 85/143* (2013.01); *H01H 85/203* (2013.01); *H01H 85/38* (2013.01); *H01H 85/47* (2013.01)

(58) Field of Classification Search

CPC .. H01H 85/175; H01H 85/055; H01H 85/143; H01H 85/203; H01H 85/38; H01H 85/47

USPC ..... 337/186

See application file for complete search history.

(56) References Cited

U.S. PATENT DOCUMENTS

| | | | | | |
|---|---|---|---|---|---|
| 1,321,949 | A * | 11/1919 | Teale | H01H 85/157 | 337/235 |
| 1,875,415 | A * | 9/1932 | Bussmann | H01H 85/153 | 337/248 |
| 2,650,283 | A * | 8/1953 | Van Hoorn | H01H 85/0456 | 337/250 |

(Continued)

FOREIGN PATENT DOCUMENTS

| | | | | |
|---|---|---|---|---|
| DE | 202013002222 U1 | * | 6/2013 | H02H 3/20 |
| ES | 1146633 U | * | 11/2015 | H01H 85/54 |
| FR | 2890781 A1 | * | 3/2007 | H01H 9/106 |

*Primary Examiner* — Anatoly Vortman

(74) *Attorney, Agent, or Firm* — Stanek Lemon Crouse & Meeks, P.A.

(57) ABSTRACT

The present utility model relates to a fuse, a vehicle circuit for an electric vehicle, and an electric vehicle. The fuse has a longitudinal direction and a transverse direction, and includes: a bushing, having a through-hole cavity extending in the longitudinal direction and for accommodating quartz sand and two end surfaces in the longitudinal direction; a fuse body, accommodated in the through-hole cavity; and two contact blades, positioned at two ends of the through-hole cavity and conductively joined to the fuse body. At least one of the contact blades comprises a first section coming into direct sealing contact with one of the end surfaces of the bushing by covering the through-hole cavity, and an overhanging arm section extending from the first section. The overhanging arm section includes a second section extending, in a direction perpendicular to the longitudinal direction, out of the bushing.

19 Claims, 7 Drawing Sheets

(56) References Cited

U.S. PATENT DOCUMENTS 3,046,373 A * 7/1962 Schweer ..... H01H 85/303 337/244
3,453,579 A * 7/1969 Pierre ..... H01H 85/044 337/203
3,986,158 A * 10/1976 Salzer ..... H01H 85/165 337/246
4,101,860 A * 7/1978 Fister ..... H01H 85/10 337/159
4,533,895 A * 8/1985 Kowalik ..... H01H 85/055 337/163
4,841,356 A * 6/1989 Howton ..... H01H 85/15 29/623
4,972,170 A * 11/1990 Ehlmann ..... H01H 85/153 337/158
5,155,462 A * 10/1992 Morrill, Jr. ..... H01G 9/0003 337/297
5,245,308 A * 9/1993 Herbias ..... H01H 85/38 29/623
5,270,679 A * 12/1993 Gulbrandsen ..... H01H 85/18 29/623
5,357,234 A * 10/1994 Pimpis ..... H01H 85/153 337/246
6,194,989 B1 * 2/2001 Douglass ..... H01H 85/10 337/228
6,507,265 B1 * 1/2003 Ackermann ..... H01H 85/10 337/278
6,801,433 B2 * 10/2004 Lindholm ..... H01H 85/47 165/170
10,535,485 B2 * 1/2020 Ando ..... H01H 85/08
2006/0284721 A1 * 12/2006 Jakobsen ..... H01H 85/143 337/187
2013/0043971 A1 * 2/2013 Chen ..... H01H 85/2045 337/205
2013/0207769 A1 * 8/2013 Faltermeier ..... H01H 85/22 337/290
2014/0240081 A1 * 8/2014 Murowaki ..... H01H 85/201 337/208
2015/0348732 A1 * 12/2015 Douglass ..... H01H 69/02 337/198
2017/0365434 A1 * 12/2017 Douglass ..... H01H 85/12
2018/0331571 A1 * 11/2018 Smit ..... H01H 85/30
2020/0168424 A1 * 5/2020 Li ..... H01H 85/08

* cited by examiner

FUSES, VEHICLE CIRCUIT FOR ELECTRIC VEHICLE AND ELECTRIC VEHICLE

CROSS-REFERENCE TO RELATED APPLICATIONS

The present application claims priority to Chinese Patent Application No. 201821973510.7; flied Nov. 28, 2018, entitled FUSE, VEHICLE CIRCUIT FOR ELECTRIC VEHICLE, AND ELECTRIC VEHICLE, the disclosure of which is incorporated herein by reference in its entirety.

TECHNICAL FIELD

The present utility model relates to the technical field of electric vehicles, and in particular to a fuse, a vehicle circuit for an electric vehicle, and an electric vehicle.

BACKGROUND

Providing short-circuit protection or overload protection currently requires connecting a fuse to a vehicle circuit of an electric vehicle. Conventional industrial fuses (for example, a fuse for protecting a semiconductor device or apparatus) are presently used by automotive manufacturers to protect electric vehicles. These conventional fuses are usually applicable to be mounted in an operating environment that is spacious, allows heat dissipation, constant, and has a stable current and voltage load with little to no shock. Conventional fuses thus do not meet the requirements for mounting in electric vehicles because the operating environment involves limited internal mounting space, the fuse is subjected to repeated shocks and vibrations under high temperature and high humidity, and the current load fluctuates from time to time.

A fuse capable of adapting to different mounting methods is thus needed in the art.

SUMMARY

The present utility model aims to provide a fuse capable of solving at least part of the above problems.

The present utility model further aims to provide a vehicle circuit for an electric vehicle employing the above improved fuse.

The present utility model further aims to provide an electric vehicle.

According to one aspect of the present utility model, a Ease is provided, the fuse having a longitudinal direction and a transverse direction, and the fuse comprising: a bushing, having a through-hole cavity extending in the longitudinal direction and for accommodating quartz sand and two end surfaces in the longitudinal direction; a fuse body, accommodated in the through-hole cavity; and two contact blades, positioned at two ends of the through-hole cavity and conductively joined to the fuse body, wherein at least one of the contact blades comprises a first section coming into direct sealing contact with one of the end surfaces of the bushing by covering the through-hole cavity, and an overhanging arm section extending from the first section, and the overhanging arm section comprises a second section extending, in a direction perpendicular to the longitudinal direction, out of the bushing.

The contact blade is mounted directly on the bushing in a sealing contact manner, and covers the through-hole cavity of the bushing, thereby eliminating the need to mount an end cover on an outer side of the contact blade. One portion/the first section of the contact blade covers the through-hole cavity, and is conductively joined (such as being soldered) to the fuse body, and the other portion extends out of the bushing to form an overhanging section. At least a portion of the overhanging section is used for insertion into a corresponding component so as to electrically connect the fuse; to a circuit. The shape of the overhanging section can be designed according to a required fuse mounting method and an interlace shape of the corresponding component (such as bending the overhanging section to form different shapes). The second section of the overhanging section extending in a direction perpendicular to the longitudinal direction is used for direct insertion into the interface of the corresponding component, or is used for spacing the bushing apart from a portion of the contact blade (such as a third section of the contact blade) to be inserted into the interface of the corresponding component so as to facilitate the insertion.

Preferably, the two contact blades each have the first section and the overhanging arm section, wherein the second sections of the two contact blades extend in the same direction. In this way, the second portions of the two overhanging arm sections are arranged in a face-to-face manner, thereby providing a contact blade having a simple structure and that is easy to insert. Herein, the second section can be inserted directly into the interface of the corresponding component.

Preferably, the two contact blades each have the first section and the overhanging arm section, wherein the second sections of the two contact blades extend away from each other. In this way, the second sections of the two overhanging arm sections are staggered, thereby providing a contact blade having a simple structure and that is easy to insert. Herein, the second section can be inserted directly into the interface of the corresponding component.

Preferably, the overhanging arm section comprises a third section extending in the longitudinal direction from an end portion of the second section away from the bushing. Therefore, contact blades having the following shapes are provided: the second portions of the two overhanging arm sections are arranged in a face-to-face manner, and the third sections of the two contact blades extend away from each other; alternatively, the second portions of the two overhanging arm sections are arranged in a face-to-face manner, and the third sections of the two contact blades extend towards each other; alternatively, the second sections of the two overhanging arm sections are staggered, and the third sections of the two contact blades extend away from each other; alternatively, the second sections of the two overhanging arm sections are staggered, and the third sections of the two contact blades extend towards each other. The contact blades with these shapes have simple structures and are easy to insert. Herein, the third section can be used for insertion into the interface of the corresponding component, and the second section is used for spacing the third section apart from the bushing so as to facilitate the insertion of the third section; alternatively, the second section and the third section can be inserted together into the interface of the corresponding component.

Preferably, the third section extends from the end portion of the second section, to which the third section is joined, towards the opposite other contact blade.

Preferably, opposite two ends of the first section are each joined to the overhanging arm section, and the second sections positioned at the opposite two ends of the first section extend away from each other. In this way, a contact blade form having a simple structure and a wide application range is provided, and a suitable overhanging arm section for insertion can be selected according to requirements.

Preferably, each overhanging arm section comprises a third section extending in the longitudinal direction from an end portion of the second section away from the bushing, in this way, a contact blade having a simple structure and that is easy to insert is provided. The third section can be used for insertion into the interface of the corresponding component, and the second section is used for spacing the third section apart from the bushing so as to facilitate the insertion of the third section; alternatively, the second section and the third section can be inserted together into the interface of the corresponding component.

Preferably, the third section extends from the end portion of the second section, to which the third section is joined, towards the opposite other contact blade.

Preferably, a fourth section is connected between the first section and the second section, and the fourth section extends in the longitudinal direction away from the bushing. Herein, the fourth section can serve as a transition section between the first section and the second section.

Preferably, a contact plate is joined to a side surface of at least one of the contact blades facing the through-hole cavity; an outer diameter of the contact plate is less than or equal to the diameter of the through-hole cavity; and the fuse body is conductively joined to the contact plate. The contact plate can position the bushing during assembly of the fuse, thereby facilitating the assembly.

Preferably, the fuse body has a plurality of openings spaced apart from each other in the transverse direction; an arc extinguishing medium layer is provided on the fuse body, and a side edge of the arc extinguishing medium layer contacts edges of any two adjacent openings of the plurality of openings so as to cause the arc extinguishing medium layer to be close to a minimum transverse spacing between the edges of the two openings.

Preferably, the transverse length of the arc extinguishing medium layer is equal to the transverse length of the fuse body.

Preferably, the plurality of openings have, in the longitudinal direction, one side relatively close to a longitudinal center of the fuse and the other side relatively away from the longitudinal center of the fuse, and the arc extinguishing medium layer is provided on the other side of the plurality of openings.

Preferably, the arc extinguishing medium layer is formed by coating the fuse body with an arc extinguishing medium; and the arc extinguishing medium comprises at least an organic adhesive. All of the materials (such as the organic adhesive) and the processes (such as coating the fuse body with the organic adhesive) involved in the present disclosure are conventional, and the present disclosure does not involve any improvements in materials and processes.

Preferably, the plurality of openings comprise a circular hole and/or an arc-shaped slot, and an edge of the arc extinguishing medium layer is tangent to or intersects an edge of the circular hole and/or the arc-shaped slot.

According to another aspect of the present utility model, a vehicle circuit for an electric vehicle is provided, the vehicle circuit comprising a fuse connected to the vehicle circuit, wherein the fuse is the above fuse.

According to another aspect of the present utility model, an electric vehicle is provided, and comprises a vehicle circuit, wherein the vehicle circuit is the above vehicle circuit for the electric vehicle.

Part of the other features and advantages of the present utility model will be obvious after a person skilled in the art reads the present utility model. The rest will be described in the following detailed description with reference to the accompanying drawings.

BRIEF DESCRIPTION OF THE DRAWINGS

Embodiments of the present utility model are described in detail below with reference to the accompanying drawings, wherein.

DESCRIPTION OF THE REFERENCE NUMERALS

Figure 1:
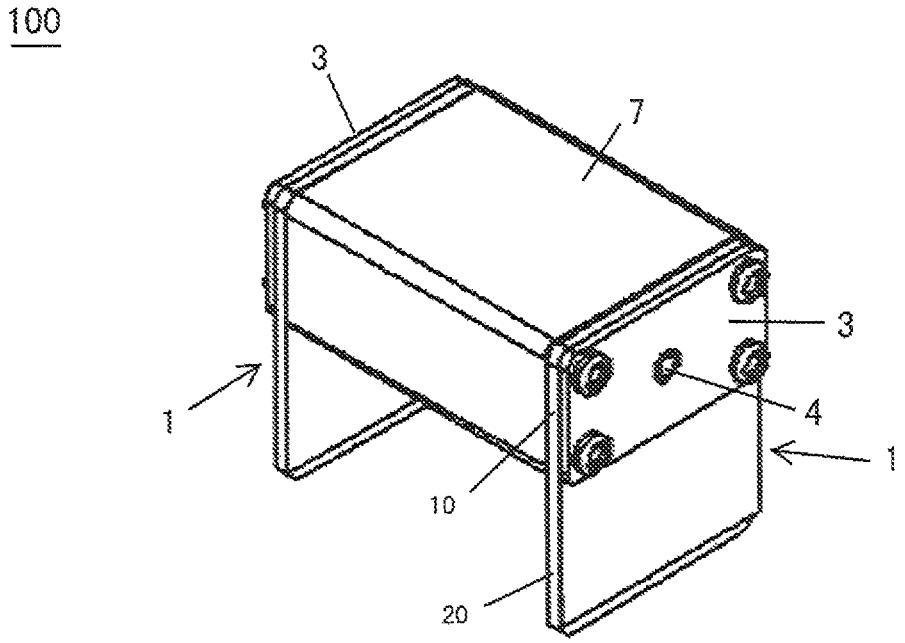
FIG. 1 is a schematic perspective view of a fuse according to a first embodiment of the present utility model.
Figure 2:
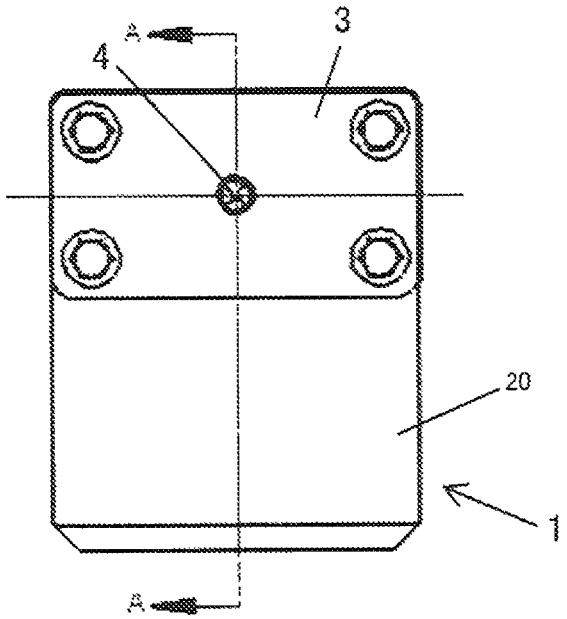
FIG. 2 is a plan view of a fuse according to a first embodiment of the present utility model.
Figure 3:
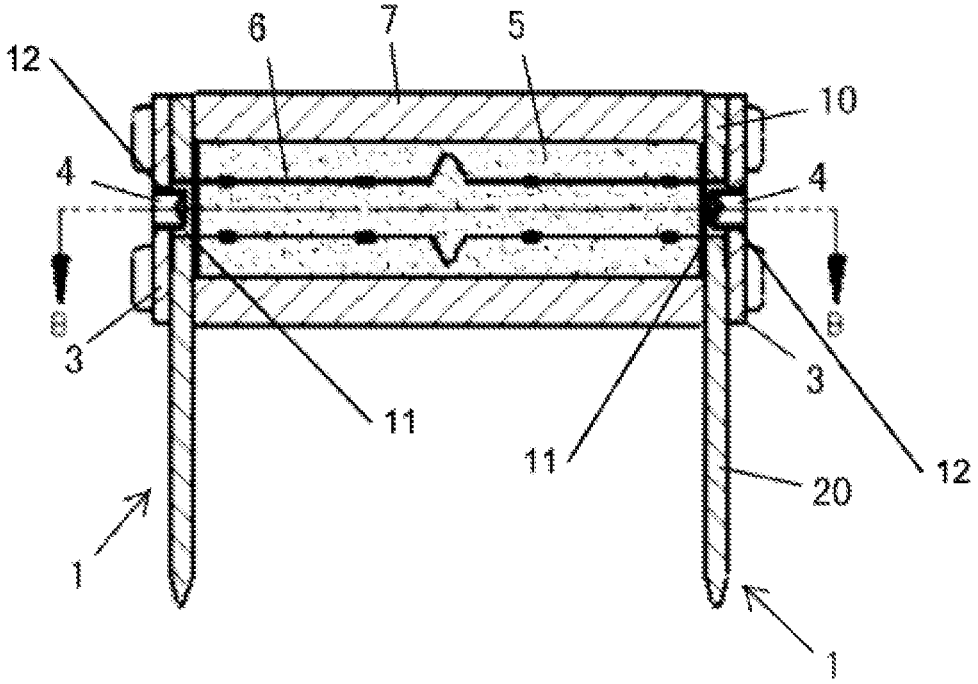
FIG. 3 is a cross-sectional view of FIG. 2 taken along a line A-A.

X Longitudinal direction
Transverse direction
I', and 1" Contact blade
10, 10', and 10" First section
20, 20', and 20" Second section
30' and 30" Third section
40" Fourth section
2' and 2" Contact plate
3 Cover plate
4, 4', and 4" Plug
5, 5' and 5" Quartz sand
6, 6', and 6" Fuse body
60, 60', and 60" Opening
7, 7', and 7' Bushing
8 Arc extinguishing medium layer
100, 100', and 100" Fuse

DETAILED DESCRIPTION

A schematic scheme of the disclosed device in the present utility model is described in detail with reference to the accompanying drawings. Although the purpose of providing the accompanying drawings is to present some implementations of the present utility model, the accompanying drawings do not need to be drawn according to the size of the specific implementation schemes. Certain features can be enlarged, removed, or partially cross-sectioned to better illustrate and explain the disclosure of the present utility model. Part of members in the accompanying drawings can be positionally adjusted according to actual requirements without affecting the technical effect. In the description, the term "in the accompanying drawings" or similar terms do not necessary refer to all of the accompanying drawings or examples.

Some directional terms used in the following to describe the accompanying drawings, such as "in," "out," "upper," and "lower," and other directional terms are construed as having normal meanings thereof and refer to those directions Involved when the accompanying drawings are viewed normally. Unless otherwise specified, the directional terms in the description are substantially in accord with conventional directions understood by a person skilled in the art.

The terms "first," "first one," "second," and "second one" and similar terms used in the present utility model do not indicate any sequence, number, or importance in the present utility model, and are used only to distinguish one component from other components.

The terms "join" and "connect" and similar terms used in the present utility model refer to two components being indirectly connected to each other by an intermediate layer (such as an adhesive and solder) or an intermediate member (such as a connection member and a transition member), and also refer to two components being directly connected to each other without any intermediate layer (such as an adhesive and solder) or any intermediate member (such as a connection member and a transition member).

FIG. 1 to FIG. 4 show a first fuse of the present utility model by providing an example. The fuse in this example is applicable to, for example, a circuit having a rated voltage of no higher than 800 V and a rated current of no higher than 630 A (such as a vehicle circuit of a household electric vehicle), the circuit being used for the following; short-circuit protection for a battery pack, a maintenance switch, and other charging and discharging circuits; overload protection for some cases where overcurrent is not permitted.

As shown in FIG. 1, the fuse is denoted by the reference numeral "100"; a direction X indicates a longitudinal direction (or a lengthwise direction) of the fuse 100, and a direction Y indicates a transverse direction (or a widthwise direction) of the fuse 100. In the illustrated embodiment, the fuse 100 includes a bushing 7, a fuse body 6, quartz sand 5 (containing a certain proportion of curing agent), two contact blades 1, and two cover plates 3.

As shown in FIG. 1 to FIG. 4, the bushing 7 has a through-hole cavity extending in the longitudinal direction X. The through-hole cavity can be, for example, a through-hole longitudinally passing through the bushing 7, such that two longitudinal ends of the bushing 7 are open in a position corresponding to the through-hole cavity. The fuse body 6 is accommodated in the through-hole cavity. The two contact blades 1 respectively cover opposite two ends of the through-hole cavity and are fixed at longitudinal end portions of the bushing 7. The contact blades 1 are fastened to the end portions of the bushing 7 using screws. In the illustrated embodiment, a side surface of each contact blade 1 facing the through-hole cavity is in direct sealing contact with a corresponding end surface of the bushing 7, that is, neither any intermediate layer (such as an adhesive and solder) nor any intermediate member (such as a connection member and a transition member) exists between the side surface of the contact blade 1 and the end surface of the bushing 7. Preferably, the contact blade 1 abuts the end surface of the bushing 7. Each contact blade 1 is soldered to the fuse body 6 so as to form an electrically conductive joint, or the contact blade 1 and the fuse body 6 can form an electrically conductive joint by other means. An inner cavity defined by the bushing 7 and the two contact blades 1 is filled with the quartz sand 5. The two cover plates 3 can be fixed to the bushing 7 using screws, and an inner side surface of each cover plate 3 facing the bushing 7 and an outer side surface of the contact blade 1 on a corresponding side facing away from the bushing 7 are arranged in a face-to-face manner. Preferably, the cover plate 3 and the contact blade 1 can be fixed to the bushing 7 using the same screw. During assembly, each of the above screws can be coated with an adhesive (such as a thread locking adhesive) to meet vibration and shock resistance requirements.

The bushing 7 can be selected from the following: a porcelain tube, an epoxy glass tube, and a composite tube. The porcelain tube is particularly suitable for a fuse connected to a circuit with a rated voltage no higher than 800 V and a rated current no higher than 630 A. Both the cover plate 3 and the screws can be made from stainless steel and can meet requirements for resistance to corrosion that is caused by a salt-containing vapor and high temperature moisture.

Figure 4:
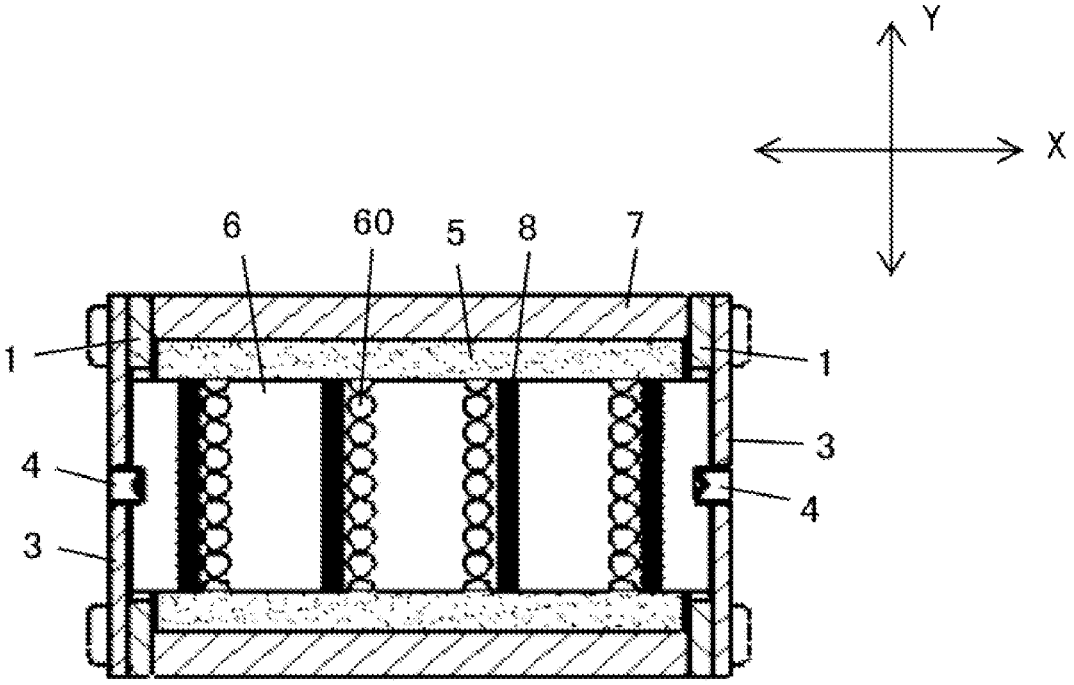
FIG. 4 is a cross-sectional view of FIG. 3 taken along a line B-B.
Figure 5:
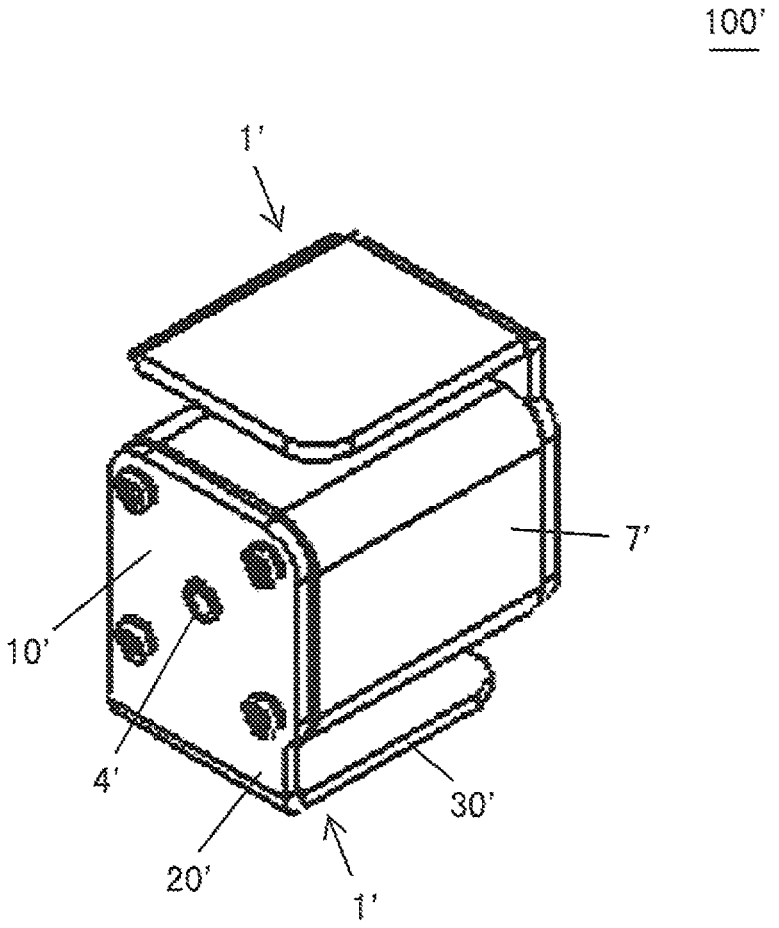
FIG. 5 is a schematic perspective view of a fuse according to a second embodiment of the present utility model.
Figure 6:
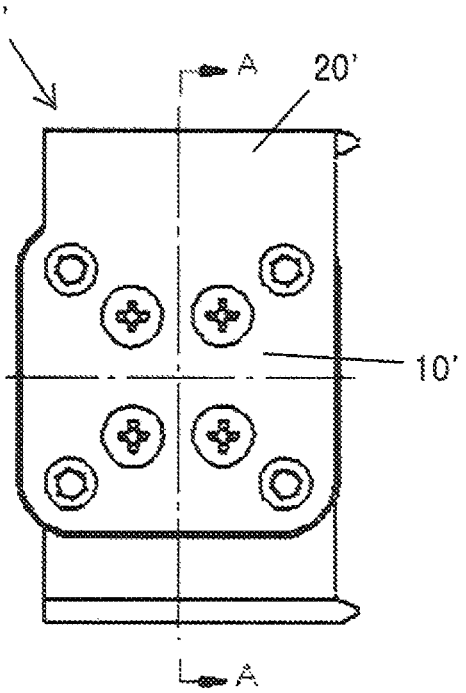
FIG. 6 is a plan view of a fuse according to a second embodiment of the present utility model.
Figure 7:
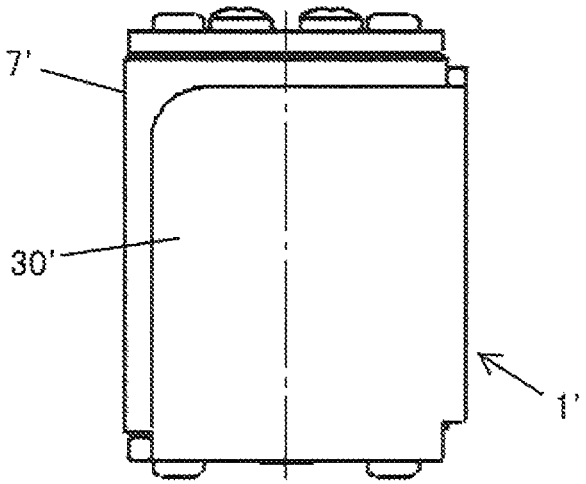
FIG. 7 is a top view of FIG. 6.
Figure 8:
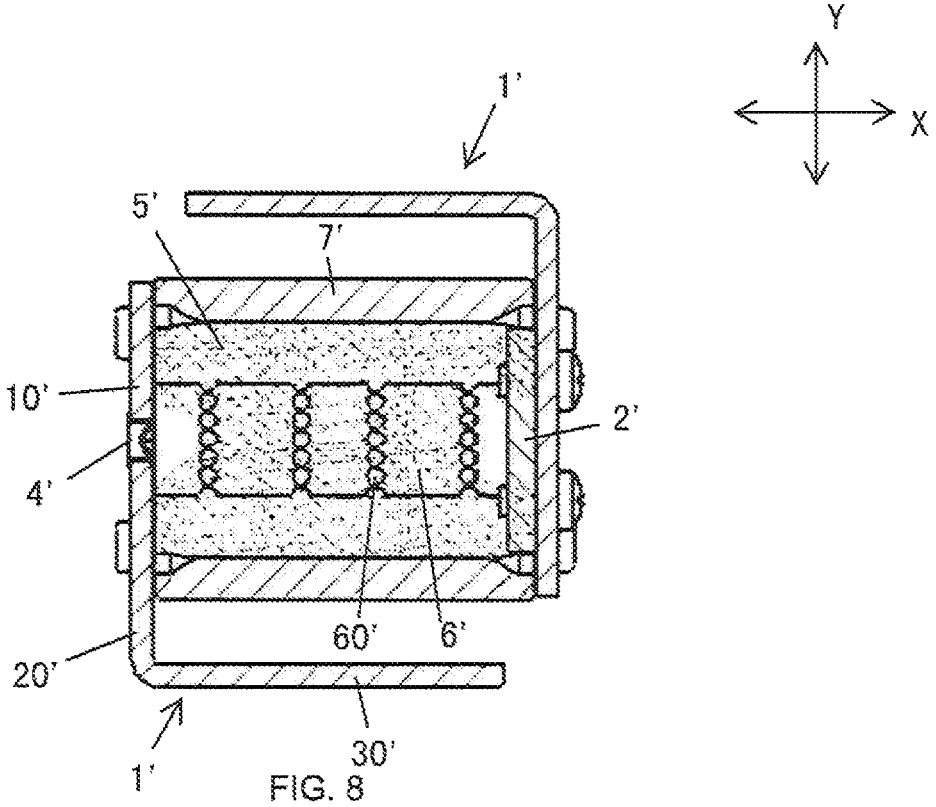
FIG. 8 is a cross-sectional view of FIG. 6 taken along a line A-A.
Figure 9:
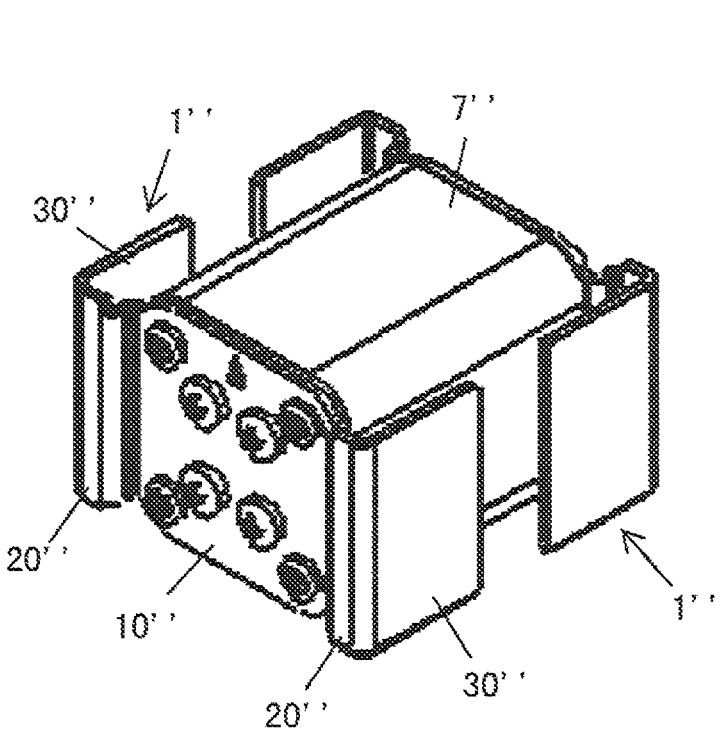
FIG. 9 is a schematic perspective view of a fuse according to a third embodiment of the present utility model.
Figure 10:
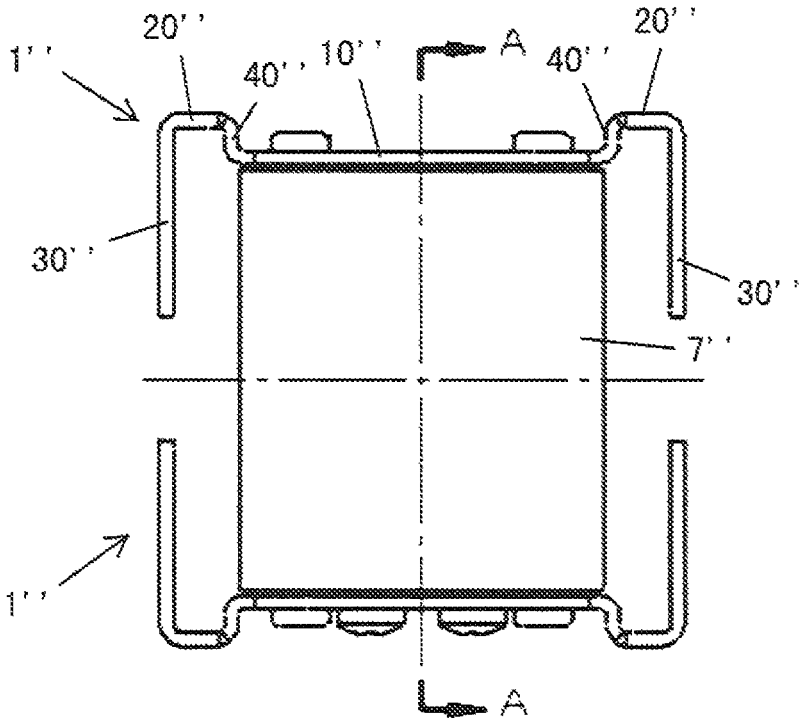
FIG. 10 is a plan view of a fuse according to a third embodiment of the present utility model.
Figure 11:
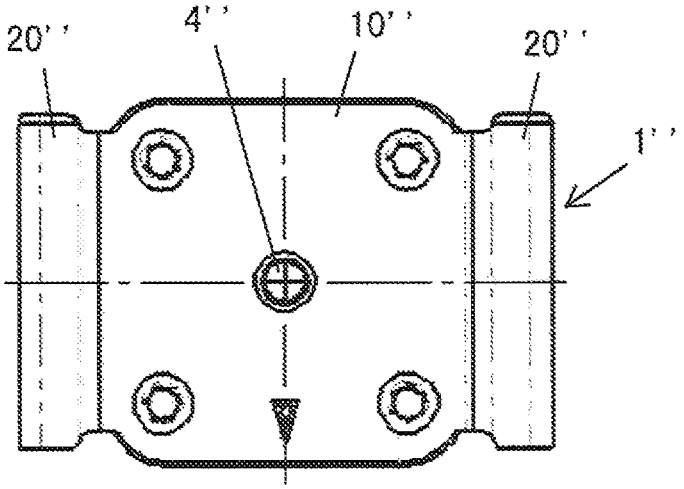
FIG. 11 is a top view of FIG. 10.
Figure 12:
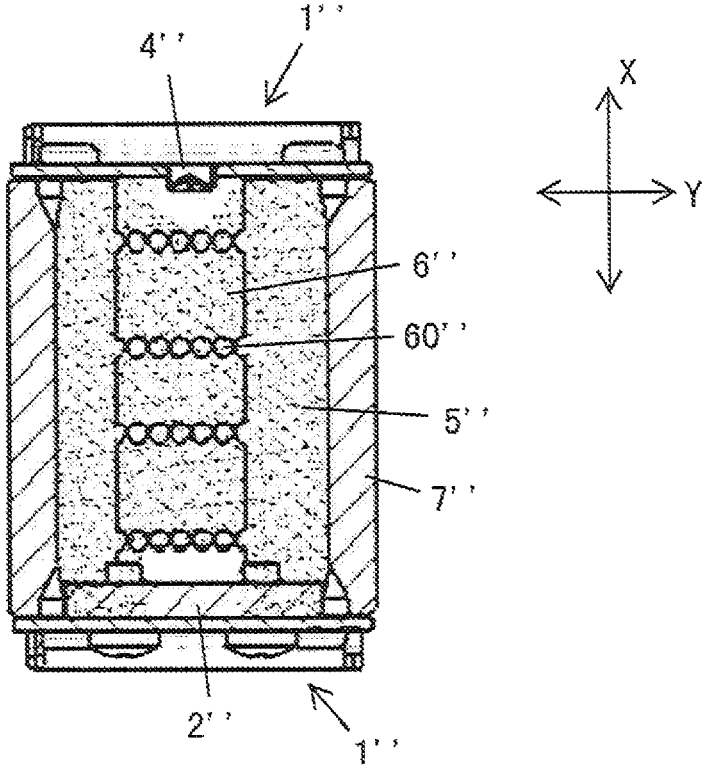
FIG. 12 is a cross-sectional view of FIG. 10 taken along a line A-A.

In the illustrated embodiment, the fuse body 6 is an elongated strip-shaped sheet. The fuse body 6 can be made from a material selected from the following materials: copper, a copper-silver composite, and pure silver. Yet a sheet having a variable cross section made by punching pure silver is a desirable selection for the fuse body 6, given it has low electrical resistance, a low melting point, and oxidation resistance. Four opening groups spaced apart from each other in the longitudinal direction X are formed on the fuse body 6. Each opening group includes nine openings 60 spaced apart from each other in the transverse direction Y. Herein, "spaced apart from each other in the transverse direction Y" includes the following cases: a line connecting the centers of all openings in each opening group is parallel to the transverse direction Y, and a line connecting the centers of all openings is slightly inclined at an angle (such as ±10°) relative to the transverse direction Y. As shown in the drawings, among the nine openings 60 of each opening group, two outermost openings 60 are arc-shaped slots, and the other seven openings 60 are circular holes. Certainly, the number of opening groups and the number of openings included in each opening group can be increased or reduced according to actual requirements (such as a preset voltage and a preset current). An edge of each opening 60 is arc-shaped. As shown in FIG. 4, a minimum transverse spacing exists between edges of two openings 60 adjacent to each other in the transverse direction. The minimum transverse spacing can also be referred to as a "narrow path," and the size thereof is less than 1 mm, such as 0.16 mm or 0.2 mm. The fuse body 6 is coated with an organic adhesive in a position as close as possible to the narrow path, so as to form an arc extinguishing medium layer 8. In the illustrated embodiment, the opening 60 is a circular hole or an arc-shaped slot, and aside edge of the arc extinguishing medium layer 8 close to the opening 60 is tangent to the edge of the opening 60, thereby causing the arc extinguishing medium layer 8 to be as close as possible to the narrow path. In addition, the side edge of the arc extinguishing medium layer 8 can also intersect the edge of the opening 60, such that the arc extinguishing medium layer 8 is as close as possible to the narrow path. No matter whether the arc extinguishing medium layer 8 is tangent to or intersects at the edge of the opening 60, the side edge of the arc extinguishing medium layer 8 contacts the edge of the opening 60.

The circular hole or the arc-shaped slot is only an example of the opening 60. The opening 60 can also be another shape, such as an ellipse, a triangle, a diamond, a star or unique special shape; further, the shape of each opening in each opening group can be different.

Coating the fuse body 6 with the arc extinguishing medium layer 8 in a position as close as possible to the narrow path ran improve the breaking capacity of the fuse 100. The principle of breaking capacity of a fuse is as follows: when the fuse breaks a short-circuit fault current, the first position where fusing and an arc occur is the narrow path. If the arc cannot be extinguished quickly, then the arc will be released from the fuse, or a fuse housing will explode. An arc extinguishing medium contained in the arc extinguishing medium layer can decompose due to the high temperature of the arc so as to generate gas; the gas is capable of forcing charged particles to enter the quartz sand to undergo cooling and deionization. The gas generated by means of decomposition increases the pressure of the inner cavity of the housing, thereby further deionizing the charged particles. The process of deionizing the charged particles is the process of arc extinguishing.

The arc extinguishing medium layer needs to be applied in a position as close as possible to the narrow path. If the arc extinguishing medium layer is far away from the narrow path, then arc burning will last for a loner period of time, and the fuse may have released an arc or may have exploded before the arc extinguishing medium's decomposition function is in effect. However, it should be noted that the narrow path cannot be coated with the arc extinguishing medium layer, and the coating of the arc extinguishing medium layer needs to, avoid the narrow path; if the narrow path is coated with the arc extinguishing medium layer, then a high temperature caused when the fuse operates normally or is slightly overloaded may cause the arc extinguishing medium layer to be consumed in advance, thereby deteriorating the arc extinguishing effect: in addition, the arc extinguishing medium layer will prevent the narrow path from contacting the quartz sand, and hinder normal circulation in the narrow path and heat conduction of the quartz sand, thereby causing the temperature of the fuse to rise.

Herein, the organic adhesive is applied as an arc extinguishing medium to a position close as possible to the narrow path to improve the breaking capacity of the fuse. However, a person skilled in the art can conceive of the following: an applicable arc extinguishing medium is not limited to the organic adhesive; all other insulation materials capable of generating gas by means of decomposition due to the high temperature of the arc can be applied as an arc extinguishing medium to the fuse body so as to form the arc extinguishing medium layer.

In the illustrated embodiment, the arc extinguishing medium layer is preferably applied to a side of each opening group relatively away from, in the longitudinal direction X, a longitudinal center of the fuse 100, such that the gas generated by mems of decomposition of the arc extinguishing medium can force the arc to be "blown" to a longitudinal middle portion of the fuse 100, thereby preventing the arc from being; "blown" to the cover plate 3 and the contact blade 1, and preventing the case in which the quartz sand undergoes breakdown caused by the arc since amount of quartz sand at two longitudinal ends of the fuse 100 is less than the amount of quartz sand in the longitudinal middle portion. However, this does not mean that the arc extinguishing medium layer 8 can be applied only to the side of the opening group shown in the drawings. In other cases, the arc extinguishing medium layer can also be applied to the other side or two longitudinal opposite sides of the opening group; however, it should be noted that the amount of arc extinguishing medium is preferably not overly large. If the amount is overly large, then the decomposition of the organic adhesive generates too much gas, such that the pressure of the inner cavity of the fuse is so high as to cause the fuse to crack.

In the illustrated embodiment, the arc extinguishing medium layer 8 is strip-shaped, and the length thereof in the transverse direction Y is approximately equal to the length of the fuse body 6 in the transverse direction Y. However, a person skilled in the art can also conceive of the following: the length of the arc extinguishing medium layer 8 in the transverse direction Y can be less than the length of the fuse body 6 in the transverse direction Y, as long as the arc extinguishing medium layer 8 is applied to a position close to a region between each two adjacent openings in each opening group, and in particular close to a narrow path between each two adjacent openings.

A first section 10 of each contact blade 1 covers the through-hole cavity of the bushing 7 and is fixed to the bushing 7, and a second section 20 extends, from the first section 10 and in a direction perpendicular to the longitudinal direction X, out of the bushing 7 to form an overhanging arm section, such that the fuse 100 is suitable for being connected to the circuit by means of insertion. In the present utility model, the first embodiment shown in FIG. 1 to FIG. 4 and second and third embodiments described below divide the contact blade into a plurality of sections (such as dividing the contact blade into a first section, a second section, a third section, and a fourth section); the purpose for this division of sections is for simplicity of description; however, it does not mean that a macroscopic or microscopic boundary/demarcation structure necessarily exists between the sections. Division of sections may be based on differences in positions and/or functions thereof. This principle is applicable not only to the three embodiments listed in the description, but also to the embodiments of different variations failing within the scope of the present utility model. For example, in the embodiment shown in FIG. 1 to FIG. 4, each contact blade 1 is a straight plate-shaped copper sheet integrally formed and having a flat surface; a portion of the copper sheet corresponding to the bushing 7 serves as the first section 10, and a portion of the copper sheet extending, in a direction perpendicular to the longitudinal direction X, out of the bushing 7 serves as the second section 20; the contact blade 1 as a whole is in the shape of "-", The second section 20 is adapted to be inserted into a matched interface so as, to electrically connect the fuse to a circuit.

In the illustrated embodiment, the second sections 20 of the two contact blades 1 extend in the same direction. However, a person skilled in the art can conceive of other structural variations. For example, the second sections 20 of the two contact blades 1 extend away from each other.

An assembly method for the fuse 100 in the embodiment includes:

1. Soldering one end of the fuse body 6 coated with the arc extinguishing medium layer 8 to a first contact blade 1, where the two contact blades 1 have corresponding recesses at soldering positions of the fuse body 6 to facilitate the soldering of the fuse body;
2. Sleeving a soldered whole member formed by the above step in the bushing 7, and using a screw to pre-fix a contact blade 1 to one end of the bushing 7, such that a first end of the bushing 7 abuts a surface of the first contact blade 1;
3. Using a screw to pre-fix a second contact blade 1 to the other end of the bushing 7, and soldering the fuse body 6 to a second contact blade 1, where the two contact blades 1 have corresponding recesses at the soldering positions of the fuse body 6 to facilitate the soldering of the fuse body, such that a second end of the bushing 7 abuts a surface of the second contact blade 1;

4. Removing the above pre-fixed screws, using screws to respectively fix the two cover plates 3 to outer sides of the above two contact blades 1, and using a fixture to tighten the screws;

5. Using a solid plug to block reserved quartz sand filling ports 11, 12 on the first contact blade 1 and a first cover plate 3;

6. Filling the inner cavity with the quartz sand 5 via reserved quartz sand filling ports 11, 12 on the second contact blade 1 and a second cover plate 3, and note that the inner cavity cannot be filled with the quartz sand 5 before the arc extinguishing medium layer 8 is solidified;

7. Using another plug having a vent hole to block the reserved quartz sand filling ports 11, 12 on the second contact blade 1 and the second cover plate 3; and 8. Placing the entire fuse in a curing oven to solidify the quartz sand in the entire fuse by means of high temperature, high humidity, and negative pressure.

FIG. 5 to FIG. 8 show a second fuse of the present utility model by providing an example. The fuse is denoted by the reference numeral "100'"; a direction X indicates a longitudinal direction (or a lengthwise direction) of the fuse 100'; and a direction Y indicates a transverse direction (or a widthwise direction) of the fuse 100'. In the illustrated embodiment, the fuse 100' includes a bushing 7', a fuse body 6' (an arc extinguishing medium layer coated thereon is not shown), quartz sand 5' (containing a certain proportion of curing agent), two contact blades 1', and a contact plate 2'. Unless otherwise stated, components of the fuse 100' have the same structure, function, and operating principle as the corresponding components of the aforementioned fuse 100. The same parts of the two embodiments will not be described here for the sake of brevity, and only the differences will be described below.

As shown in FIG. 5 to FIG. 8, the fuse body 100' eliminates the need for two cover plates, and the two contact blades 1' are directly pressed at longitudinal opposite two ends of the bushing 7' using screws. The contact blades 1' seal two ends of a through-hole cavity of the bushing. Each of the contact blades includes a first section 10' covering the through-hole cavity of the bushing 7' and fixed by a screw; a second section 20' extending, from the first section 10' and in a direction perpendicular to the longitudinal direction X, out of the bushing 7'; and a third section 30' extending in the longitudinal direction X from an end portion of the second section 20' away from the bushing 7', the second section 20' and the third section 30' being configured to be in the form of an overhanging arm section. The third section 30' can be formed, for example, by bending a copper sheet, such that the contact blade 1' as a whole is in the shape of "L". The third section 30' is used for insertion into a matched interface so as to electrically connect the fuse 100' to a circuit, and the second section 20' spaces the third section 30' from the bushing 7' so as to facilitate the insertion of the third section 30'. Alternatively, herein, the second section 20' and the third section 30' can be inserted together into the matched interface.

In the illustrated embodiment, the second sections 20' of the two contact blades extend away from each other, and the third sections 30' of the two contact blades 1' each extend towards the opposite contact blade 1'. However, a person skilled in the art can conceive of other structural variations. For example, the second sections 20" of the two contact blades extend in the same direction, or the third sections 30' of the two contact blades 1' each extend away from the opposite contact blade 1'. Herein, all of the elements and features in different variations of the contact blade not only can be used interchangeably with and in combination with the elements and features of the contact blade 1' shown in FIG. 5 to FIG. 8, but also can be used interchangeably with and in combination with the elements and features of the contact blade 1 shown in FIG. 1 to FIG. 4.

In the embodiment shown in FIG. 5 to FIG. 8, one end of the fuse body 6' is soldered to one of the contact blades and the other end is soldered to the contact plate 2'; the contact plate 2' is fixed to the other contact blade 1' by a screw. The diameter of the contact plate 2' is equal to or slightly less than the diameter of the through-hole cavity of the bushing 7', such that the contact plate 2' can be accommodated in the bushing 7' so as to assist positioning of the bushing 7'.

An assembly method for the fuse 100' in the embodiment includes:

1. Using a fixture to solder one end of the fuse body 6' coated with the arc extinguishing medium layer to a first contact blade 1' and to solder the other end to the contact plate 2';

3. Sleeving the bushing 7' on the fuse body 6' and the contact plate 2', and using the contact plate 2' to perform positioning;

4. Using a screw to fix the bushing 7' to the first contact blade 1';

5. Using a screw to fix a second contact blade 1' to the bushing 7', and using a screw to fix the contact plate 2' to the second contact blade 1';

6. Filling the inner cavity with the quartz sand 5' via a reserved quartz sand filling port on the first contact blade 1';

7. Using a plug 4' having a vent hole to block the quartz sand filling port; and 9. Placing the entire fuse in a curing oven to solidify the quartz sand in the entire fuse by means of high temperature, high humidity, and negative pressure.

FIG. 9 to FIG. 12 show a third fuse of the present utility model by providing an example. The fuse is denoted by the reference numeral "100" "; a direction X indicates a longitudinal direction (or a lengthwise direction) of the fuse 100", and a direction Y indicates a transverse direction (or a widthwise direction) of the fuse 100". In the illustrated embodiment, the fuse 100" includes a bushing 7", a fuse body 6" (an arc extinguishing medium layer coated thereon is not shown), quartz sand 5" (containing a certain proportion of curing agent), two contact blades 1", and a contact plate 2". Unless otherwise stated, components of the fuse 100" have the same structure, function, and operating principle as the corresponding components of the aforementioned fuse 100 and fuse 100'. The same parts of the two embodiments will not be described here for the sake of brevity, and only the differences will be described below.

As shown in FIG. 9 to FIG. 12, each of the contact blades 1" includes a first section 10" covering a through-hole cavity of the bushing 7" and fixed to an end portion of the bushing 7" by a screw; two second sections 20" respectively extending, from opposite two ends of the first section 10" and in a direction perpendicular to the longitudinal direction X, away from each other out of the bushing 7"; and third sections 30" each extending, in the longitudinal direction X, from an end portion of each of the second sections 20" away from the bushing 7". A fourth section 40" extending in the longitudinal direction X is further connected between the first section 10" and each of the second sections 20". The second sections 20" and the third sections 30" connected to each other or the fourth sections 40", the second sections 20", and the third sections 30" connected to each other constitute an overhanging arm section. Each of the sections 20", 30", and 40" can be formed, for example, by bending a copper sheet.

In the illustrated embodiment, the third sections 30" on corresponding sides of the two contact blades 1" each extend toward the opposite contact blade 1". However, a person skilled in the art can conceive of other structural variations. For example, the third sections 30' on the corresponding sides of the two contact blades 1" each extend away from the opposite contact blade 1". All of the elements and features in different variations of the contact blade 1" can be used interchangeably with and in combination with the elements and features of the contact blade 1 shown in FIG. 1 to FIG. 4, the elements and features of the contact blade 1" shown in FIG. 5 to FIG. 8, and the elements and features of the contact blade 1" shown in FIG. 9 to FIG. 12. The third section 30" is used for insertion into a matched interface so as to electrically connect the fuse 100" to a circuit, and the second section 20" and the fourth section 40" space the third section 30" from the bushing 7" so as to facilitate the insertion. Alternatively, the third section 30" and the second section 20" can be inserted together into the matched interface.

It should be appreciated that although the description is presented according to each embodiment, each embodiment does not necessarily include only one independent technical solution. The presentation manner of the description is merely for clarity, and a person skilled in the art should regard the description as a whole. The technical solutions in the embodiments can also be appropriately combined to form other implementations comprehensible by a person skilled in the art.

What is described above is merely exemplary specific implementations of the present utility model; it is not intended to limit the scope of the present utility model. Any equivalent change, modification, or combination made by a person skilled in the art without departing from the conception and principle of the present utility model shall fall within the protection scope of the present utility model.

The invention claimed is:

1. A fuse comprising:

a bushing having a through-hole cavity extending in a longitudinal direction;

a fuse body in the through-hole cavity;

two contact blades positioned at two respective ends of the through-hole cavity and conductively joined to the fuse body, wherein at least one of the contact blades comprises a first section covering at least one of the ends of the through-hole cavity and having an opening therein configured to serve as a port to the cavity and a second section connected to the first section and extending away from the bushing in a direction perpendicular to the longitudinal direction; and at least one cover plate on the at least one of the contact blades and having an opening therein aligned with the opening in the at least one of the contact blades.

2. The fuse according to claim 1, wherein the two contact blades each have the first section and the second section, wherein the second sections of the two contact blades extend in the same direction.

3. The fuse according to claim 1, wherein the two contact blades each have the first section and the second section, and wherein the second sections of the two contact blades extend away from the bushing in opposite directions.

4. The fuse according to claim 1, wherein the at least one of the contact blades comprises a third section extending from the second section in the longitudinal direction from an end portion of the second section away from the bushing.

5. The fuse according to claim 4, wherein the third section of the at least one of the contact blades extends towards another one of the contact blades.

6. The fuse according to claim 1, wherein the second section comprises respective second sections at opposite ends of the first section and extending in opposite directions.

7. The fuse according to claim 6, wherein the at least one of the contact blades comprises respective third sections extending from the respective second sections in the longitudinal direction.

8. The fuse according to claim 7, wherein the third sections of the at least one of the contact blades extend toward another one of the contact blades.

9. The fuse according to claim 8, wherein the first section and respective ones of the second sections are joined by respective fourth sections that extend in the longitudinal direction away from the bushing.

10. The fuse according to claim 1, wherein a contact plate is disposed in the through-hole cavity, conductively joined to the fuse body and conductively joined to a surface of the at least one of the contact blades facing the through-hole cavity.

11. The fuse according to claim 1, wherein the fuse body has a plurality of openings spaced apart from each other in a direction transverse to the longitudinal direction, wherein an arc extinguishing medium layer is provided on the fuse body, and wherein the arc extinguishing medium layer contacts edges of two adjacent openings of the plurality of openings.

12. The fuse according to claim 11, wherein width of the arc extinguishing medium layer in the transverse direction is equal to width of the fuse body in the transverse direction.

13. The fuse according to claim 11, wherein the plurality of openings have, in the longitudinal direction, one side relatively close to a longitudinal center of the fuse and the other side relatively away from the longitudinal center of the fuse, and the arc extinguishing medium layer is provided on the other side of the plurality of openings.

14. The fuse according to claim 11, wherein the arc extinguishing medium layer comprises an organic adhesive.

15. The fuse according to claim 11, wherein each of the plurality of openings comprise a circular hole and/or an arc-shaped slot, and wherein an edge of the arc extinguishing medium layer is tangent to or intersects an edge of the circular hole and/or the arc-shaped slot.

16. A fuse comprising:

a bushing;

a fuse body in an internal cavity of the bushing;

a contact blade electrically connected to the fuse body and comprising:

a first section that abuts an end of the bushing, covers an end of the cavity, and has an opening therein configured to serve as a port to the cavity;

a second section connected to the first section that extends away from the bushing in a direction perpendicular to a longitudinal dimension of the bushing;

an arc extinguishing agent on the fuse body;

a cover plate on the first section of the contact blade and having an opening aligned with the opening in the first second of the contact blade; and a quartz sand in the cavity and surrounding the fuse body.

17. The fuse of claim 16, wherein the contact blade further comprises a third section connected to the second section and extending parallel to the longitudinal dimension.

18. The fuse of claim 17, wherein the contact blade is attached at a first end of the bushing and wherein the third section extends toward a second end of the bushing.

19. The fuse according to claim 1, further comprising a plug in the openings in the at least one of the contact blades and the at least one cover plate.

* * * * *